US006775587B1

(12) United States Patent
Absar et al.

(10) Patent No.: US 6,775,587 B1
(45) Date of Patent: Aug. 10, 2004

(54) METHOD OF ENCODING FREQUENCY COEFFICIENTS IN AN AC-3 ENCODER

(75) Inventors: Mohammed Javed Absar, Singapore (SG); Sapna George, Singapore (SG)

(73) Assignee: STMicroelectronics Asia Pacific Pte Ltd., Singapore (SG)

( * ) Notice: Subject to any disclaimer, the term of this patent is extended or adjusted under 35 U.S.C. 154(b) by 0 days.

(21) Appl. No.: 10/129,047

(22) PCT Filed: Oct. 30, 1999

(86) PCT No.: PCT/SG99/00109

§ 371 (c)(1),
(2), (4) Date: Jan. 14, 2003

(87) PCT Pub. No.: WO01/33718

PCT Pub. Date: May 10, 2001

(51) Int. Cl.[7] ..... G10L 19/02
(52) U.S. Cl. ..... 700/200.1; 704/205
(58) Field of Search ..... 704/200–201, 704/203–230

(56) References Cited

U.S. PATENT DOCUMENTS 5,214,706 A * 5/1993 Minde ..... 704/218
5,581,653 A 12/1996 Todd ..... 704/229
5,752,225 A * 5/1998 Fielder ..... 704/229
5,960,401 A * 9/1999 Rao et al. ..... 704/500
5,970,461 A * 10/1999 Chatterton ..... 704/500
6,356,871 B1 * 3/2002 Hemkumar et al. ..... 704/500
6,493,674 B1 * 12/2002 Takamizawa ..... 704/501

FOREIGN PATENT DOCUMENTS

JP 7-199996 8/1995
WO WO 99/35758 7/1999

OTHER PUBLICATIONS

McKinney, "Digital Audio Compression (AC–3)—ATSC Standard," Dec. 20, 1995, XP–002075746.

* cited by examiner

*Primary Examiner*—David D. Knepper
(74) *Attorney, Agent, or Firm*—Lisa K. Jorgenson; Robert Iannucci; Seed IP Law Group PLLC

(57) ABSTRACT

A method for encoding frequency coefficients in an AC-3 Encoder. The method includes: representing frequency coefficients in theform of a respective exponent and mantissa; coding the exponents; and shifting the mantissas to compensate for changes in the exponent values, wherein the exponents comprise an original exponent set $(e_0, e_1, \ldots e_{n-1})$ which is mapped to a new exponent set $(e_0', e_1', \ldots, e'_{n-1})$ after coding, so as to satisfy: $\|e'_{i+1}-e'_i\|<D$, where i=0, . . . , $n_{-1}$ and D is a maximum allowed difference between two consecutive exponents, and $e'_i \leqq e_i$.

4 Claims, 2 Drawing Sheets

| bap | quantizer levels | quantization types | mantissa bits(qntztab[bap]) (group bits / num in group) |
|---|---|---|---|
| 0 | 0 | none | 0 |
| 1 | 3 | symmetric | 1.67(5/3) |
| 2 | 5 | symmetric | 2.33(7/3) |
| 3 | 7 | symmetric | 3 |
| 4 | 11 | symmetric | 3.5(7/2) |
| 5 | 15 | symmetric | 4 |
| 6 | 32 | asymmetric | 5 |
| 7 | 64 | asymmetric | 6 |
| 8 | 128 | asymmetric | 7 |
| 9 | 256 | asymmetric | 8 |
| 10 | 512 | asymmetric | 9 |
| 11 | 1,024 | asymmetric | 10 |
| 12 | 2,048 | asymmetric | 11 |
| 13 | 4,096 | asymmetric | 12 |
| 14 | 16,384 | asymmetric | 14 |
| 15 | 65,536 | asymmetric | 16 |

*source : ATSC Doc. A52/95

FIGURE 1

METHOD OF ENCODING FREQUENCY COEFFICIENTS IN AN AC-3 ENCODER

FIELD OF THE INVENTION

This invention is applicable in the field of an AC-3 Encoder, implemented on a DSP Processor and, in particular, relates to a method of encoding frequency coefficients.

BACKGROUND OF THE INVENTION

Recent years have witnessed an unprecedented advancement in audio coding technology. This has led to high compression ratios while keeping audible degradation in the compressed signal to a minimum. Coders such as the AC-3 (popularly known as Dolby Digital) are intended for a variety of applications, including 5.1 channel film soundtracks, HDTV, laser discs and multimedia.

The translation of the AC-3 Encoder Standard "ATSC Digital Audio Compression (AC-3) Standard", Doc. A/52/10, November 1994 on to the firmware of a DSP-Core involves several phases. Firstly, the essential compression algorithm blocks for the AC-3 Encoder have to be designed. After individual blocks are completed, they are integrated into an encoding system which receives a PCM (pulse code modulated) stream, processes the signal applying signal processing techniques such as transient detection, frequency transformation, masking and psychoacoustic analysis, and produces a compressed stream in the format of the AC-3 Standard.

The coded AC-3 stream should be capable of being decompressed by any standard AC-3 Decoder and the PCM stream generated thereby should be comparable in audio quality to the original input stream. If the original stream and the decompressed stream are transparent (indistinguishable) in audible quality (at reasonable level of compression) the development moves to the third phase.

In the third phase the algorithms are simulated in a high level language (e.g. C) using the word-length specifications of the target DSP-Core. Most commercial DSP-Cores allow only fixed point arithmetic (since a floating point engine is costly in terms of area). Consequently the algorithm is translated to a fixed point solution. The word-length used is usually dictated by the ALU (arithmetic-logic unit) capabilities and bus-width of the target core. For example AC-3 Encoder on Motorola's 56000 would use 24-bit precision since it is a 24-bit Core. Similarly, for implementation on Zoran's ZR38000 which has 20-bit data path, 20-bit precision would be used.

If, for example, 20-bit precision is discovered to provide an unacceptable level of sound quality, the provision to use double precision always exists. In this case each piece of data is stored and processed as two segments, lower and upper words, each of 20-bit length. The accuracy of implementation is doubled but so is the computational complexity and memory requirement—double precision multiplication could require 6 or more cycles while single precision multiplication and addition (MAC) requires only a single cycle. Moreover, double precision also requires twice the amount of storage space.

AC-3 is a transform coder, which essentially means that the input time-domain samples are converted to frequency domain coefficients during the first step of encoding. As discussed earlier, the coefficients may be generated through a single-precision or double-precision computation, whichever is considered appropriate. Each coefficient is next represented by a mantissa and an exponent, and subjected to different encoding schemes. While it seems intuitive to store mantissas with same or more number of bits as that used to express the coefficients in order to maintain same level of accuracy, this is not always true. The mantissa generally has a bit length which is determined by a bit allocation algorithm which globally determines the number of bits to be assigned to each mantissa, based on, for example, a parametric model of human hearing. The mantissas occupy about 30% of data memory in an AC-3 Encoder System.

SUMMARY OF THE INVENTION

The present invention seeks to minimise mantissa storage requirements without affecting accuracy.

In accordance with the invention, there is provided a method of encoding, including:

representing frequency coefficients in the form of a respective exponent and mantissa;

coding the exponents; and shifting the mantissas to compensate for changes in the exponent values, wherein the exponents comprise an original exponent set $(e_0, e_1, \ldots, e_{n-1})$ which is mapped to a new exponent set $(e_0', e_1', \ldots e'_{n-1})$ after coding, so as to satisfy:

$\|e'_{i+1} - e'_i\| < D$, where $i=0, \ldots, n-1$ and D is a maximum allowed difference between two consecutive exponents, and $e'_i \leqq e_i$.

Preferably, modifying the mantissas includes right shifting the mantissas by a number of bits corresponding to the changes in the associated exponent value.

Preferably, the coding of the exponents is a differential coding of exponent values, followed by grouping of the coded exponents according to a predetermined exponent strategy.

BRIEF DESCRIPTION OF THE DRAWINGS

The invention is more fully described, by way of non-limiting example only, with reference to the drawings, in which:

FIG. 1 is a schematic representation of an AC-3 encoding system, and

DETAILED DESCRIPTION OF A PREFERRED EMBODIMENT

Figure 2:
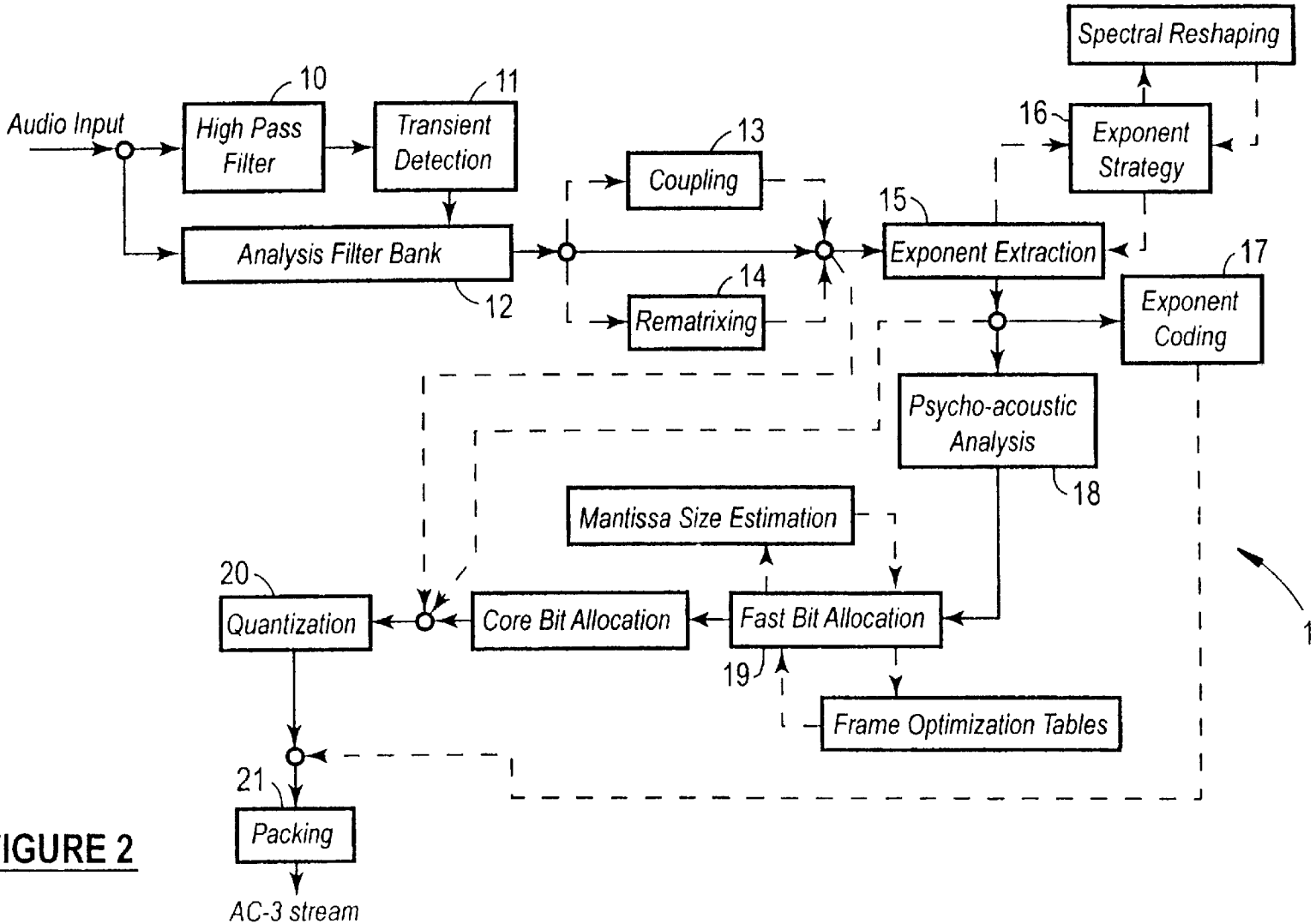
FIG. 2 is a table illustrating mapping of a bit allocation pointer (bap) to Quantizer.

Like the AC-2 single channel coding technology from which it derives, AC-3 is essentially an adaptive transform-based coder using a frequency-linear, critically sampled filterbank based on the Princen Bradley Time Domain Aliasing Cancellation (TDAC) J. P. Princen and A. B. Bradley, "*Analysis/Synthesis Filter Bank Design Based on Time Domain Aliasing Cancellation", IEEE Trans. Acout. Speech, Signal Processing*, vol. ASSP-34, no. 5, pp. 1153–1161, October 1986.

The input to the encoder is a continuous stream of digital data obtained either from a stored medium (such as CD or DVD) or directly from the Analog-to-Digital converter which samples a music signal at a continuous rate defined by the sampling frequency. The input stream is continuous but for encoding purpose it is best to section it into frames and blocks and work on one frame at a time. In AC-3 six blocks of data, comprising a frame, are buffered before encoding begins. So in a real-time operation, while one frame is being encoded, the previous one will be transmitted in encoded form to the decoder (or any receiver), while the next frame will be buffered at input.

The input samples AC-3 go through a process of transformation before appearing finally in the AC-3 frame. The first step is the Frequency Transformation. Each block of digital samples is converted from time-domain to the frequency domain, producing an equal number of what is known as frequency coefficients. These coefficients may optionally go through coupling and rematrixing before being converted to floating point format of mantissa and exponent. A brief overview of the AC-3 encoding process is shown in FIG. 1.

A.AC-3 Encoder System

The major processing blocks of the AC-3 encoder 1 are shown in FIG. 1. A brief description is provided below, with special emphasis on issues which are relevant to the subject of the present invention.

A.1 Input Format

AC-3 is a block structured coder, so one or more blocks of time domain signal, typically 512 samples per block and channel, are collected in an input buffer before proceeding with additional processing.

A.2 Transient Detection

A signal block for each channel is next analysed with a high pass filter 10 to detect presence of transients by detector 11. This information is used to adjust the block size of the TDAC (time domain aliasing cancellation) filter bank, restricting quantization noise associated with the transient within a small temporal region about the transient. In presence of transient the bit 'blksw' for the channel in the encoded bit stream in the particular audio block is set.

A.3 TDAC Filter

Each channel's time domain input signal is individually windowed and filtered with a TDAC-based analysis filter bank 12 to generate frequency domain coefficients. If the blksw bit is set, meaning that a transient was detected for the block, then two short transforms of length 256 each are taken, which increases the temporal resolution of the signal. If not set, a single long transform of length 512 is taken, thereby providing a high spectral resolution.

A.4 Coupling

Further compression can be achieved in AC-3 by use of a technique known as coupling at coupling block 13. Coupling takes advantage of the way the human ear determines directionality for very high frequency signals. At high audio frequency (approx. above 4 KHz.), the ear is physically unable to detect individual cycles of an audio waveform and instead responds to the envelope of the waveform. Consequently, the encoder combines the high frequency coefficients of the individual channels to form a common coupling channel. The original channels combined to form the coupling channel are called the coupled channel.

A.5 Rematrixing

An additional process, rematrixing, is invoked at 14 in the special case that the encoder is processing two channels only. The sum and difference of the two signals from each channel are calculated on a band by band basis, and if, in a given band, the level disparity between the derived (matrixed) signal pair is greater than the corresponding level of the original signal, the matrix pair is chosen instead. More bits are provided in the bit stream to indicate this condition, in-response to which the decoder performs a complementary unmatrixing operation to restore the original signals. The rematrix bits are omitted if the coded channels are more than two. The benefit of this technique is that it avoids directional unmasking if the decoded signals are subsequently processed by a matrix surround processor, such as Dolby Prologic decoder.

A.6 Conversion to Floating Point

The transformed values, which may have undergone rematrix and coupling process, are converted to a specific floating point representation, resulting in separate arrays of exponents and mantissas. This floating point arrangement is maintained through out the remaining part of the coding process, until just prior to the decoder's inverse transform, and provides 144 dB dynamic range, as well as allows AC-3 to be implemented on either fixed or floating point hardware.

Coded audio information consists essentially of separate representation of the exponent and mantissas arrays. The remaining coding process focuses individually on reducing the exponent and mantissa data rate.

The exponents are extracted at block 15 and coded at 17 using one of the exponent coding strategies 16. Each mantissa is truncated to a fixed number of binary places. The number of bits to be used for coding each mantissa is to be obtained from a bit allocation algorithm which is based on the masking property of the human auditory system, i.e. psycho-acoustic analysis 18, followed by bit allocation 19.

A.7 Exponent Coding Strategy

Exponent values in AC-3 are allowed to range from 0 to −24. The exponent acts as a scale factor for each mantissa. Exponents for coefficients which have more than 24 leading zeros are fixed at −24 and the corresponding mantissas are allowed to have leading zeros.

AC-3 bit stream contains exponents for independent, coupled and the coupling channels. Exponent information may be shared across blocks within a frame, so blocks 1 through 5 may reuse exponents from previous blocks.

AC-3 exponent transmission employs differential coding technique, in which the exponents for a channel are differentially coded across frequency. The first exponent is always sent as an absolute value. The value indicates the number of leading zeros of the first transform coefficient. Successive exponents are sent as differential values which must be added to the prior exponent value to form the next actual exponent value.

The differential encoded exponents are next combined into groups. The grouping is done by one of the three methods: D15, D25 and D45. These together with 'reuse' are referred to as exponent strategies. The number of exponents in each group depends only on the exponent strategy. In the D15 mode, each group is formed from three exponents. In D45 four exponents are represented by one differential value. Next, three consecutive such representative differential values are grouped together to form one group. Each group always comprises of 7 bits. In case the strategy is 'reuse' for a channel in a block, no exponents are sent for that channel and the decoder reuses the exponents last sent for this channel.

Pre-processing of exponents prior to coding can lead to better audio quality.

Choice of the suitable strategy for exponent coding forms a crucial aspect of AC-3. D15 provides the highest accuracy but is low in compression. On the other hand transmitting only one exponent set for a channel in the frame (in the first audio block of the frame) and attempting to 'reuse' the same exponents for the next five audio blocks, can lead to high exponent compression but also sometimes very audible distortion.

A.8 Bit Allocation for Mantissas

The bit allocation algorithm analyses the spectral envelope of the audio signal being coded, with respect to masking effects, to determine the number of bits to assign to each transform coefficient mantissa. In the encoder, the bit allocation is recommended to be performed globally on the ensemble of channels as an entity, from a common bit pool.

The bit allocation routine contains a parametric model of the human hearing for estimating a noise level threshold, expressed as a function of frequency, which separates audible from inaudible spectral components. Various parameters of the hearing model can be adjusted by the encoder depending upon the signal characteristic. For example, a prototype masking curve is defined in terms of two piece wise continuous line segment, each with its own slope and y-intercept.

B. Accuracy Demands on Mantissa

Suppose the frequency coefficients generated by the TDAC Filter-Bank are L bits long. The accuracy of the system which generates these coefficients is not in question here and so it will be assumed that all coefficient values are accurate up to L bits, when compared to an engine which computes TDAC using infinite precision.

Suppose L=8 and a particular coefficient is c="0010 0000". It is then to be interpreted as $(0.0100000)_2$, i.e. in two's complement floating point format. Also note that $(0.0100000)_2=(0.250..)_{10}$ and $(1.0000000)_2=(-1)_{10}$, where subscript 10 means the equivalent number in the decimal system.

When these coefficients are converted to AC-3 floating point format of exponent and mantissa, the corresponding length requirements for accurate representation of mantissa and exponent are L and $[\log_2 L]$, respectively. Conversion of a coefficient (c) to mantissa (m) and exponent (e) will proceed in two steps on most Fixed-Point DSP processor. In the first step the number of leading zeros (if number is positive) or leading ones (if number is negative) is detected to obtain the exponent. The mantissa is obtained by removing leading zeros (or ones) by the process of normalisation, i.e. m=c<<e (the operator << is the common arithmetic left shift operator). Therefore in the above example, e=1,m="0.1000000"

At different points in the AC-3 encoding process whenever the exponent value needs to be changed, corresponding changes are made in the mantissa value. The first such point is the exponent coding.

B.1 Effect of Exponent Coding on Mantissa Accuracy

In exponent coding, as mentioned earlier, grouping schemes such as D15, D25, D45 and REUSE may be utilised. A group of exponents are represented by one single value. This value is a function F[e] of all exponents (e=ei, ei+1,. . . ) that are within the group. It is based on a similar version of the following theorem:

Theorem

Let $m=(m_0m_1m_2 \ldots m_{L-1})_2$ and e be, respectively, the mantissa and exponent representing the coefficient c such that $c=m_i>>e$ (>> is arithmetic right shift). Mantissa m is assumed to be in normalised form, that is $m=0.1m_2m_3 \ldots$ (for +ve numbers) and $m=1.0m_2m_3 \ldots$ (for −ve numbers), when $m\neq 0$.

If the mantissa bits transmitted as $m'_0m'_1m'_2m'_3 \ldots m'_{L-1}$, are always interpreted by receiver (decoder) as $m'_1.m'_1m'_2m'_3 \ldots$ (in twos complement form), then the coding of exponent e as e' where $e'\leqq e$ can always be compensated by right shifting the mantissa by $\|e_i-e'_i\|$, which has same effect as prefixing the transmitted mantissa $m_0m_1m_2 \ldots m_{L-1}$, with $\|e_i-e'_i\|$ leading zeros (for +ve numbers) or leading ones (for −v numbers). Coding the exponent $e_i$ as $e'_i$ where $e'_i>e_i$ may result in loss of information.

To qualify the last statement in the above theorem, suppose m="01000000" and e=2. Then $C=(0.0010000)_2$. If e=2 is changed to e'=1 and mantissa is adjusted to m'="00100000", the coefficient c=m'>>e'="00100000">>1= "00010000"$=(0.0010000)_2$ is still the same. If e=2 is changed to e'=3 no adjustment in the mantissa can compensate for the change (right shifting m will make it a negative number, equivalent to overflow).

Based on the above theorem, the value which will be best representative of a group of exponents is the minimum of all elements in the group, i.e. $F[e]=\min(e_i,e_{i+1}, \ldots)$. For any element $e_j$, in the set $(e_i,e_{i+1}, \ldots)$, $e_j-F[e]$, and this will ensure that adjustment of mantissa does not lead to error.

Coming back to the question of mantissa accuracy upon exponent coding, it would seem that to hold mantissa bits after adjustments due to exponent grouping, the register (or any storing entity) should be greater than L by the number used for shifting. This would be true in the general case, but since exponent coding is the first process in which mantissa undergoes any adjustment and so in this case therefore is some specific peculiarity about mantissa accuracy that we note here. The mantissa is formed by removing leading zeros (or ones) from the L bit long coefficient and is stored in an L bit long register. If n leading zeros are removed, then n zeros would be shifted into the lsb (least significant bits). Since min function is used to choose the representative exponent, it is only these zeros shifted in at lsb that would at most would be lost. Therefore a L bit long register is adequate to store mantissa at this stage.

B.2 Effect of Exponent Reshaping on Mantissa Accuracy

The differential coding of exponents with a limit on maximum allowable difference between any two consecutive exponents may result in signal distortion. The differential-constraint may force some exponents to be coded to a value larger than the original, while others may be restricted to smaller number than the original.

According to theorem above, an exponent coded to a value smaller than the original does not result in any information loss. However, an exponent restricted to a larger value may result in information loss. The intent of reshaping algorithm which attempts to prevent this information loss, is to map the original exponents to a new a set of values such that they satisfy the differential-constraint.

Suppose the original exponents are $(e_0,e_1,e_2 \ldots ,e_{n-1})$. The reshaping algorithm must map these exponents to a new set $(e'_0,e'_1,e'_2, \ldots ,e'_{n-1})$ such that 1. $\|e'_{i+1}-e'_i\|<D, i=0 \ldots n-1$. Here, D is the maximum allowed difference between two consecutive exponents. Satisfying this condition essentially is equivalent to satisfying the differential-constraint.

2. $e'_i\leqq ei$, for i=0 . . . n−1. If this condition is satisfied, then by theorem above, no information loss occurs.

After the exponents have been mapped to new values, the corresponding mantissas are adjusted to compensate for the change. Since $e'_i\leqq e_i$, this involves only right shift of the mantissa. If originally the mantissa was stored in L bits, the adjusted mantissa would require $L+(e_i-e'_i)$ bits.

B.3 Effect of Quantization on Mantissa Accuracy

In AC-3, all mantissas are quantized at quantisation block 20 prior to packing at 21 for storage or transmission Quantisation is performed to a fixed level of precision dictated by the corresponding bit allocation pointer (bap). Mantissas quantized to 15 or fewer levels use symmetric quantization. Mantissas quantized to more than 15 levels use asymmetric quantization which is a conventional two's complement representation.

Some quantized mantissa values are grouped together and encoded into a common codeword. In the case of the 3-level quantizer, 3 quantized values are grouped together and represented by a 5-bit codeword in the data stream. In the case of the 5-level quantizer, 3 quantized values codeword. For the 11-level quantizer, 2 quantized values are grouped and represented by a 7-bit codeword.

The table of FIG. 2 indicates which quantizer to use for each bap. If a bap equals 0, no bits are sent for the mantissa. Grouping is used for baps of 1, 2 and 4 (3, 5 and 11 level quantizers).

The important point to note from the table is that only leading 16 bits of mantissa are, at best, finally transmitted to decoder. Therefor, if up till quantization stage, most significant 16 bits of mantissa are faithfully accurate then mantissa storage mechanism does not effect the encoding quality.

D. Mantissa Storage Requirements in AC-3

Based on the previous analysis we observe that if the mantissas are 16 bit accurate at quantization stage, additional accuracy is not required.

In section B, it was noted that after the TDAC Filter-Bank stage, the coefficients are L bit long. Normal PCM is 16-bit so L is normally more than 16, to provide good accuracy of representation in frequency domain. For a 24-bit DSP, L would be probably 24 (single precision) or 48 (double precision). For a 16-bit DSP L, likewise, would be 16 or most likely 32.

After the coefficient is converted to mantissa and exponent, the storage size (in bits) of mantissa needs to be decided. Let's proceed backwards to get an answer. At quantization stage at best, most significant 16 bits of mantissa is needed. Prior to that is exponent reshaping. Since adjustment of mantissa after reshaping involves only right shifting, 16 bits of mantissa before adjustment is all that is needed. During exponent coding, as observed earlier, again right shift is only allowed. Therefore, in all, after Frequency Transformation, 16 bits are sufficient for storing mantissas.

To sum up, sixteen bits are sufficient for storing mantissa from the point it is generated from coefficients, to the point it is quantized and packed into AC-3 frame.

The question of necessary dwells on two things. First is the accuracy of the frequency coefficients, itself. If the coefficient gives accuracy less than sixteen bits, then it does not matter very much whether the inaccurate bits are stored or discarded. Assuming the frequency transformation generates coefficients accurate beyond sixteen bits, which should be the normal case, the second issue is how many bits of mantissa are;finally packed into the AC-3 frame. Since in the best case a maximum of sixteen mantissa bits may be packed and in the worst case (due to masking or low bit-rate constraints) zero bits may be packed, the sufficient number of bits is data dependent.

What is claimed is:

1. A method of encoding, including:

representing frequency coefficients in the form of a respective exponent and mantissa;

coding the exponents; and shifting the mantissas to compensate for changes in the exponent values, wherein the exponents comprise an original exponent set $(e_0, e_1, \ldots, e_{n-1})$ which is mapped to a new exponent set $(e_0', e_1', \ldots e'_{n-1})$ after coding, so as to satisfy:

$\|e'_{i+1} - e'_i\| < D$, where $i=0, \ldots, n-1$ and D is a maximum allowed difference between two consecutive exponents, and $e'_i, e_i$.

2. A method as claimed in claim 1, wherein modifying the mantissas includes right shifting the mantissas only by a number of bits corresponding to the changes in the associated exponent value.

3. A method as claimed in claim 1, wherein the coding of the exponents is a differential coding of exponent values, followed by grouping of the coded exponents according to a predetermined exponent strategy.

4. A method as claimed in any one of claims 1 to 3, wherein AC-3 encoding is adopted and each mantissa is represented by 16 bits to minimise memory requirements for data compression whilst satisfying predetermined data quality requirements.

* * * * *

UNITED STATES PATENT AND TRADEMARK OFFICE

CERTIFICATE OF CORRECTION

PATENT NO. : 6,775,587 B1 
DATED : August 10, 2004
INVENTOR(S) : Mohammed Javed Absar et al.

It is certified that error appears in the above-identified patent and that said Letters Patent is hereby corrected as shown below:

Column 8,
Line 25, "and $e`_{i,}e_{i}$." should read as -- and $e`_{i} \leq e_{i}$.. --

Signed and Sealed this

Ninth Day of November, 2004

JON W. DUDAS
*Director of the United States Patent and Trademark Office*